US006796428B1

(12) United States Patent
Ong

(10) Patent No.: US 6,796,428 B1
(45) Date of Patent: Sep. 28, 2004

(54) EXPANDING ENVELOPE WITH BUILT-IN DIVIDER

(76) Inventor: Bon S. Ong, P.O. Box 4247, Torrance, CA (US) 90510

( * ) Notice: Subject to any disclaimer, the term of this patent is extended or adjusted under 35 U.S.C. 154(b) by 151 days.

(21) Appl. No.: 10/252,137

(22) Filed: Sep. 23, 2002

(51) Int. Cl.[7] ..... B65D 27/00; B31B 33/00

(52) U.S. Cl. ..... 206/425; 229/67.3; 493/231; 493/918

(58) Field of Search ..... 402/500, 502, 402/73; 281/15.1; 206/425; 229/67.1, 67.3, 67.4; 150/112; 493/186, 189, 210, 231, 918, 947

(56) References Cited

U.S. PATENT DOCUMENTS

| | | | | | |
|---|---|---|---|---|---|
| 325,676 | A | | 9/1885 | Jenkins | |
| 1,455,419 | A | | 5/1923 | Ahlquist | |
| 2,333,798 | A | | 3/1943 | Kner | |
| 3,536,116 | A | * | 10/1970 | Margolis | 150/103 |
| 4,262,838 | A | | 4/1981 | Mackensie | |
| 4,274,577 | A | | 6/1981 | Walsh, Jr. | |
| 4,730,727 | A | * | 3/1988 | Petroff | 206/311 |
| 5,271,502 | A | | 12/1993 | Chang | |
| 5,292,300 | A | * | 3/1994 | Bluemle | 493/231 |
| 5,664,724 | A | | 9/1997 | Ho | |
| 5,799,862 | A | * | 9/1998 | Gray | 229/68.1 |
| 6,558,063 | B2 | * | 5/2003 | Ho | 402/73 |
| 6,612,771 | B1 | * | 9/2003 | Su | 402/57 |

* cited by examiner

*Primary Examiner*—Jacob K. Ackun, Jr.
(74) *Attorney, Agent, or Firm*—Charles H. Thomas

(57) ABSTRACT

An expanding, portable envelope for use in transporting papers compartmentalized into organized sections is formed of a base sheet and a divider sheet. The two sheets are secured by a pair of transverse lines of sealing across the bottom of the envelope. A pair of divider panels is thereby created from a single divider sheet. Moreover, the bottoms of the pockets created between the divider sheets and the front and rear panels formed from the base sheet are closed, so that papers cannot slip down underneath the divider panels. The base sheet defines side panels that extend from one of the front and rear panels, and are heat sealed to the other. Bottom attachment tongues formed as extensions from the side panels are directed inwardly toward each other at the bottom of the envelope and are also permanently attached to the divider sheet so as to close and reinforce the bottom corners of the expanding envelope.

17 Claims, 4 Drawing Sheets

EXPANDING ENVELOPE WITH BUILT-IN DIVIDER

BACKGROUND OF THE INVENTION

1. Field of the Invention

The present invention relates to portable expanding envelopes that are utilized to organize papers into different sections between divider panels.

2. Description of the Prior Art

In the past, various office supply filing envelopes have been devised for the purpose of organizing papers within a portable filing envelope. Conventional devices of this type are typically constructed with a front cover panel, a rear cover panel, and a bottom or spine panel located therebetween. The sides of the front and rear covers are typically joined together by side panels, which often employ one or more folds extending from bottom to top so that the side panels are collapsible. One or more divider panels may be located within the envelope so formed in order to organize the contents of the envelope into different compartmentalized sections. The side edges of the divider sheet or sheets are often attached to the side panels of the envelope, but are frequently left unattached to the bottom or spine panel.

In conventional filing envelopes of this type, papers stored in the envelope will frequently slip down beneath the lower edges of the when the envelope is transported or used. When this occurs the user is often frustrated in attempting to locate specific papers, since they appear not to be within the file section in which they had been placed. In addition, when papers slip partially beneath the lower edges of the divider sections, they often become wrinkled and crumpled. Important papers can become damaged in this way.

SUMMARY OF THE INVENTION

A primary object of the present invention is to provide a portable expanding envelope with built-in dividers which is easy to construct and which provides a barrier to papers slipping beneath the divider panels. Unlike conventional portable, expanding file folders, the envelope of the present invention provides a safeguard against papers slipping beneath the file section dividers and becoming difficult to find, crumpled, and damaged.

A further object of the present invention is to provide an improved filing envelope system in which an envelope can be constructed with internal divides very easily and quite economically.

Still another object of the invention is to provide a portable filing envelope with built-in dividers that may be utilized to reliably sort papers into different sections between the divider panels and between the front and rear panels of the envelope.

In one broad aspect the present invention may be considered to be an expanding envelope with built-in dividers comprising: an expansive base sheet formed of a resilient, stiff material, and an expansive divider sheet formed of a resilient, stiff material. The base sheet is delineated into a front cover panel, a rear cover panel, and collapsible side panels on opposite sides of the front and rear cover panels. The base sheet also includes a narrow spine panel located between the front and rear cover panels. The spine panel is delineated from the front and rear cover panels by a pair of base sheet bottom folds. The spine panel is divided transversely by a center fold into front and rear collapsible sections. The divider sheet is delineated into front and rear divider panels and a binder panel located between the front and rear divider panels. The binder panel is also divided transversely by a center fold into front and rear collapsible sections. The front and rear collapsible sections of the divider panel are respectively secured to the front and rear collapsible sections of the spine panel.

The side panels are both divided by center folds at which they are collapsible. The collapsible side panels secure the front and rear cover panels to each other with the front and rear divider panels located therebetween. The collapsible side panels are provided with bifurcating center folds that extend substantially parallel to the front and read cover panels.

To fabricate the expanding envelope of the present invention the divider sheet is laid atop the base sheet. The two sheets are then secured together, preferably by mutually parallel lines of heat sealing that are located on opposite sides of the transverse, center fold in the spine panel.

Both the base sheet and the divider sheet are then counterfolded, on both sides of the center fold in the spine panel in a direction opposite the spine panel center fold so as to delineate the front and rear cover panels on the base sheet and front and rear divider panels on the divider sheet. The side panels are formed as lateral extensions of the base sheet from either the front or the rear cover panel. The side panels are then folded from the cover panel from which they extend toward the opposite cover panel, and are secured thereto, preferably by further lines of heat sealing.

By fastening the base sheet and divider sheet together at the bottom of the envelope structure, pockets are created between the divider panels and the front and rear cover panels. These pockets are closed at the bottom of the envelope. Papers can therefore not slip down beneath the divider panels, as occurs in some conventional expanding envelopes.

In another broad aspect the invention may be considered to be an expanding envelope with built-in dividers comprising an expansive base sheet and an expansive divider sheet, both formed of a resilient, stiff material. Both the base sheet and the divider sheet are preferably formed of a resilient, economical plastic, such as polypropylene or polyethylene.

The base sheet is folded transversely to form a base sheet center fold and is counterfolded transversely on both sides of the base sheet center fold to form a pair of base sheet bottom folds parallel to and spaced from the base sheet center fold. This construction allows the base sheet to be collapsible at the base sheet center fold and also delineates front and rear envelope panels from the base sheet. These front and rear envelope panels project upwardly from the base sheet bottom folds.

The base sheet further defines laterally projecting side panels that extend between and permanently secure the front and rear envelope panels together in mutually facing relationship. The side panels are folded inwardly toward each other and are doubled back to delineate bifurcating side panel folds perpendicular to the base sheet center fold. In this way the side panels are collapsible at the center side panel folds.

The divider sheet is folded transversely to form a divider sheet center fold parallel to and in registration with the base sheet center fold. The divider sheet is also counterfolded to form divider sheet bottom folds parallel to and spaced from the divider sheet center fold. This construction delineates front and rear divider panels located between and respectively facing the front and rear envelope panels. The divider sheet center fold lies adjacent and parallel to the base sheet center fold. This allows the divider sheet to be collapsible with the base sheet at the divider sheet center fold.

The base sheet and the divider sheet are permanently secured together between their center folds and their bottom folds. Preferably, both the base sheet and divider sheet are formed of sheets of plastic and are secured to each other between their center folds and the bottom folds by mutually parallel straight sealing lines that lie on opposite sides of the center folds. The lines of sealing are preferably formed by heat sealing the two sheets together.

In another broad aspect the invention may be considered to be a method of fabricating expandable envelopes with built-in dividers. The method of the invention utilizes an expansive base sheet having opposing side panels and an expansive divider sheet. Both the base sheet and the divider sheet are formed of a resilient, stiff material.

According to the method the divider sheet is positioned atop the base sheet in contact therewith. The fabricator then permanently secures the divider sheet and the base sheet together along a pair of mutually parallel, transverse front and rear lines of attachment. The base sheet and divider sheet are then folded upwardly together parallel to and between the transverse lines of attachment to create transverse, collapsible center folds therein. The sheets are then counterfolded together in both front and rear, mutually parallel transverse bottom folds so that the front line of attachment resides between the center folds and the front bottom folds and so that the rear line of attachment resides between the center folds and the rear bottom folds. This creates from the base sheet front and rear cover panels, each having a top and a bottom. It also creates from the divider sheet a pair of divider panels between the front and rear cover panels. The side panels project outwardly from a first one of the front and rear cover panels.

Both of the side panels of the base sheet are then folded toward each other to span the distance of separation between the front and rear cover panels. Each of the side panels is also folded longitudinally back upon itself so as to form a longitudinal, bifurcating fold in each of the side panels. The side panels are permanently secured to a second one of the front and rear cover panels longitudinally from the top to the bottom thereof.

Preferably, both the base sheet and the divider sheet are formed of plastic, such as polyethylene or polypropylene, and the lines of attachment of these sheets together is preferably formed by heat sealing.

Preferably also, the base sheet is further comprised of bottom attachment tongues projecting from the side panels. The bottom attachment tongues are directed toward each other and are sealed to the divider sheet between the front and rear folds therein. The bottom attachment tongues are also preferably sealed to the spine panel formed from the base sheet.

The invention may be described with greater clarity and particularity by reference to the accompanying drawings.

DESCRIPTION OF THE EMBODIMENTS AND IMPLEMENTATION OF THE METHOD

Figure 1:
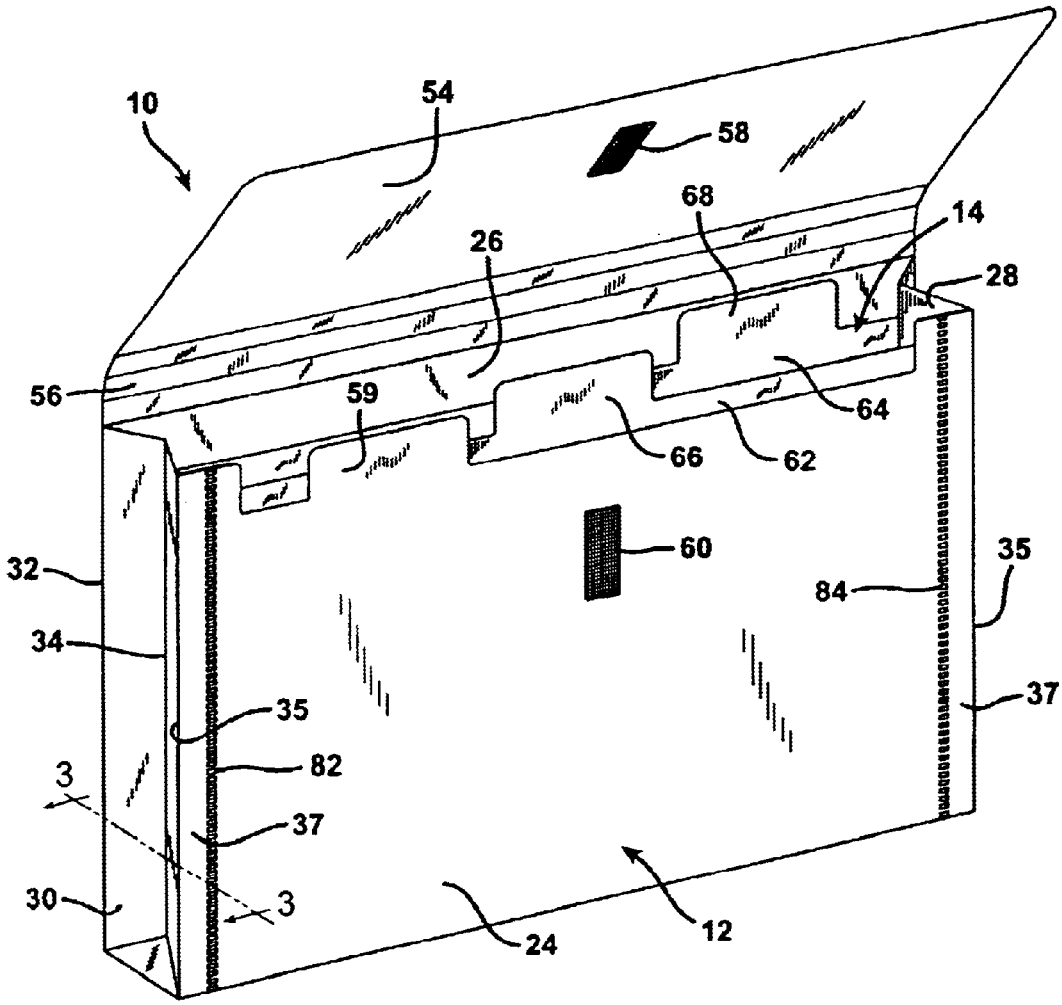
FIG. 1 a perspective view of an expanding envelope with built-in dividers constructed according to the present invention.
Figure 2:
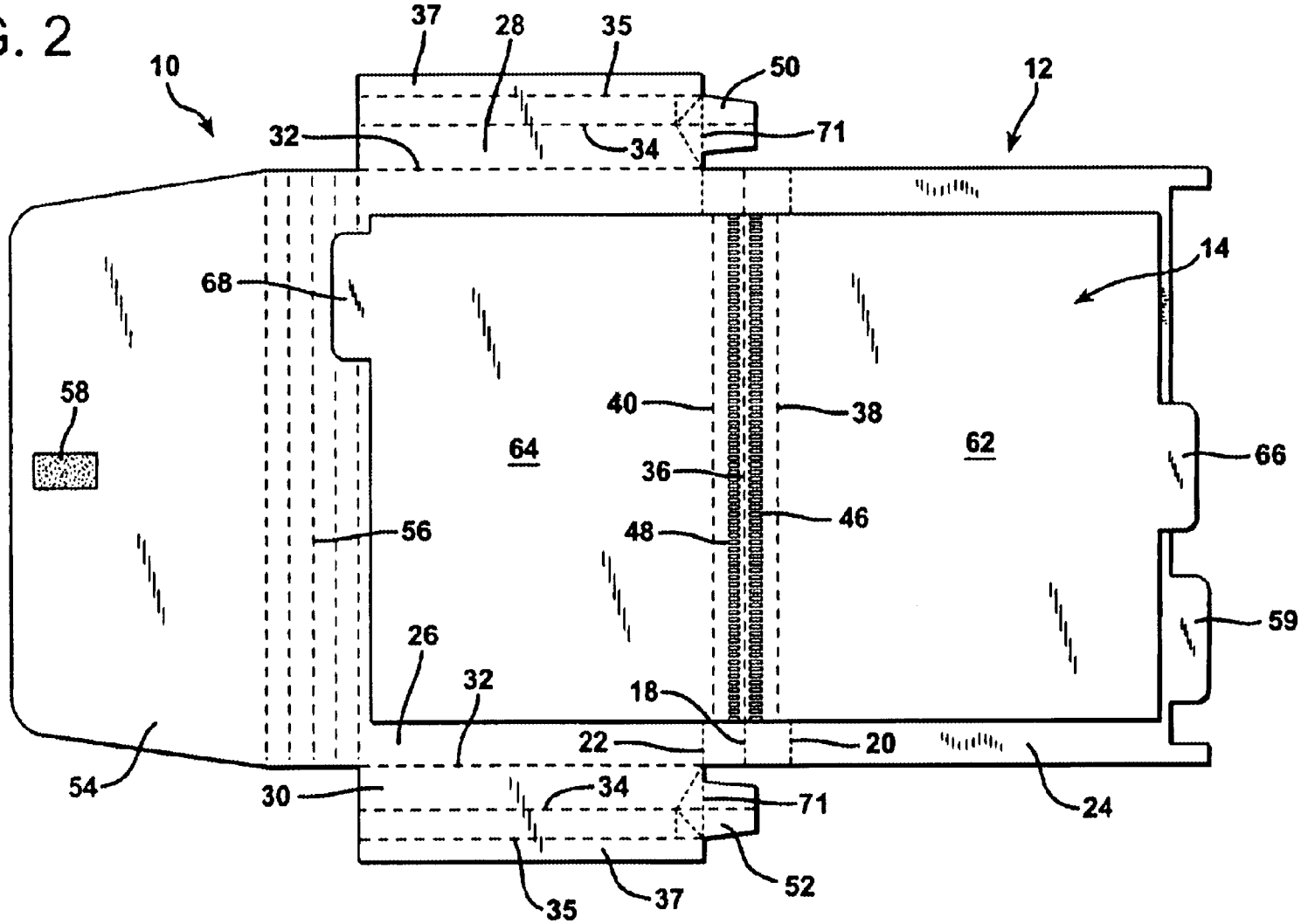
FIG. 2 is a top plan view illustrating the divider sheet atop the base sheet prior to folding but following attachment of the divider sheet and the base sheet together.

FIG. 1 illustrates an expanding envelope indicated generally at 10 which is formed of a base sheet 12 and a divider sheet 14, both illustrated in FIG. 2.

Figure 3:
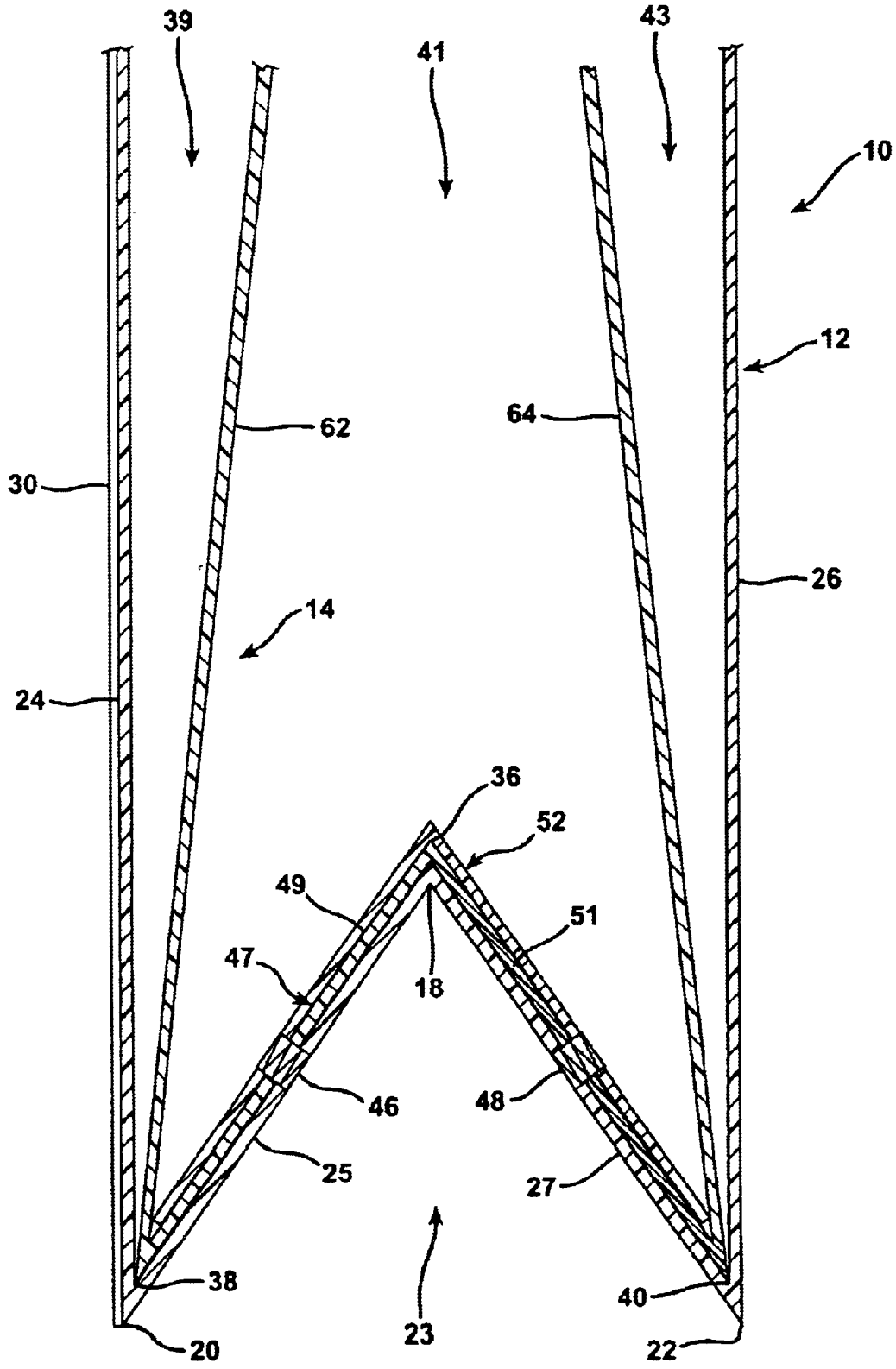
FIG. 3 is a sectional elevational detail taken along the lines 3—3 in FIG. 1.

As illustrated in FIGS. 2 and 3, the base sheet 12 is formed as a stiff, but resilient, expansive sheet of plastic and is folded transversely to form a base sheet center fold 18. The base sheet 12 is counterfolded transversely on both sides of the base sheet center fold 18 to form a pair of base sheet bottom folds, which are shown as the front bottom fold 20 and the rear bottom fold 22 in FIG. 3. The base sheet bottom folds 20 and 22 define a narrow spine panel 23 therebetween. The spine panel 23 of the base sheet 12 is collapsible at the center fold 18 to delineate a collapsible front bottom section 25 and a collapsible rear bottom section 27. Also, the bottom folds 20 and 22 delineate front and rear envelope panels 24 and 26, respectively, from the base sheet 12. The front and rear envelope panels 24 and 26 project upwardly from the bottom folds 20 and 22, respectively.

The base sheet 12 further defines laterally projecting, collapsible side panels 28 and 30, illustrated prior to folding in FIG. 2. When the base sheet 12 and divider sheet 14 are folded into the configuration required to create the expanding filing envelope 10, the side panels 28 and 30 extend between and permanently secure the front and rear envelope cover panels 24 and 26 together. As illustrated in FIG. 3, the front and rear envelope panels 24 and 26 reside in mutually facing relationship. The side panels 28 and 30 are folded inwardly toward each other from the rear envelope panel 26 at rear side edge demarcation folds 32, visible in FIG. 1, and are doubled back to delineate bifurcating center folds 34. The side panels 28 and 30 are thereby collapsible, as indicated in FIGS. 1 and 2. Each of the side panels 28 and 36 is further folded at 35 parallel to the bifurcating folds 34 to define elongated side edge fastening strips or tabs 37. The fastening tabs 37 are folded over into contact with the front cover panel 24, and are heat sealed thereto at lines of heat sealing 82 and 84.

The divider sheet 14 is folded transversely to form a divider sheet center fold 36. The divider sheet 14 is also counterfolded to form a pair of divider sheet bottom folds, which are shown as front and rear bottom folds 38 and 40, respectively. The divider sheet bottom folds 38 and 40 are parallel to and spaced from the divider sheet center fold 36 so that the divider sheet 14 is collapsible on both sides of the divider sheet center fold 36, which lies atop the base sheet center fold 18.

The divider sheet bottom folds 38 and 40 delineate a front divider panel 62 and a rear divider panel 64. The front and rear divider panels 62 and 64 are located between and respectively face the front envelope cover panel 24 and the rear envelope cover panel 26. The front and rear envelope cover panels 24 and 26, together with the front and rear divider panels 62 and 64, form three separate pockets therebetween. These pockets are shown at 39, 41, and 43 in FIG. 3.

As illustrated in FIGS. 2 and 3, the base sheet 12 and the divider sheet 14 are permanently secured together by mutually parallel lines of attachment by heat sealing, indicated at 46 and 48. The front line of heat sealing attachment 46 is located between the center folds 18,36 and the front bottom folds 20,38. The rear line of heat sealing attachment 48 is located between the center folds 18,36 and the rear bottom folds 22,40.

The expanding envelope 10 is fabricated from the base sheet 12 and divider sheet 14 with those sheets both initially residing in a flat, unfolded condition with the divider sheet 14 positioned atop the base sheet 12, as illustrated in FIG. 2. As shown in that drawing figure the side panels 28 and 30 of the base sheet 12 project laterally outwardly from the sides of the rear panel 26. Preferably, and in the embodiment shown, bottom fastening tongues 50 and 52 project longitudinally from the side panels 28 and 30, respectively, and project beyond the specific one of the front and rear panels 24 and 26 at which the side panels 28 and 30 are attached. More particularly, in the embodiment of FIG. 2, the fastening tongues 50 and 52 extend beyond the rear panel 26 adjacent the spine panel 23.

The base sheet 12 further defines a top closure flap 54 which, in the finished product, projects upwardly from the rear panel 26. The top closure flap 54 is joined to the top of the rear panel 26 by a top panel 56 that has a plurality of articulated folds parallel to the transverse folds 18, 20 and 22 of the base sheet 12. In the finished envelope 10 the top panel 56 of the base sheet 12 is folded transversely between the top closure flap 54 and the rear panel 26 so that the top closure flap 54 extends downwardly to enclose the upper portion of the front panel 24 therewithin, as is evident from FIG. 1.

Preferably also, the top closure flap 54 and the front panel 24 are provided with mutually engageable releaseable closure elements 58 and 60. In the embodiment of the invention illustrated these closure elements 58 and 60 are mutually engageable mating flexible hook and loop fabric fastener pads of the type sold under the registered trademark Velcro®. The pad 58 is secured to the interior surface of the top closure flap 54 while the pad 60 is secured to the exterior surface of the front panel 24. The pad 58 contains a multiplicity of tiny fabric hooks that are releaseable engageable in a fabric pile located on the mating pad 60. When the top closure flap 54 is folded down over the top of the enclosure of the expanding envelope 10, the mating closure elements 58 and 60 releaseably engage each other and hold the top closure flap 54 against the front cover panel 24.

The front cover panel 24 has a lower edge defined by the front bottom fold 20 and an upper edge from which a tab 59 projects upwardly. The tab 59 is suitable for receiving an adhesive backed label to indicate the contents of the front pocket 39 in the expanding envelope 10.

The divider sheet 14 is a bifurcated structure, divided down its center transversely by the fold 36. The divider sheet is counterfolded at 38 and 40 to delineate the divider sheet 14 into a front divider panel 62 and a rear divider panel 64. The divider panels 62 and 64 are provided with upwardly projecting labeling tabs 66 and 68 respectively.

In the construction of the expanding envelope 10 the divider sheet 14 is first laterally centered and positioned atop the base sheet 12 in contact therewith prior to creating any folds. The divider sheet 14 is then permanently secured to the base sheet 12 utilizing a heat sealing machine to create a pair of straight, mutually parallel, transverse lines of attachment, which are the front line of heat sealing 46 and the rear line of heat sealing 48. The heat sealing lines 46 and 48 extend transversely across the entire width of the divider sheet 14.

The base sheet 12 and the divider sheet 14 are then folded upwardly together to create the transverse center folds 18 and 36 respectively therein. The center folds 18 and 36 are parallel to and lie midway between the transverse lines of attachment 46 and 48.

The base sheet 12 and divider sheet 14 are then counterfolded together to create front and rear mutually parallel transverse bottom folds. Specifically, the front portion of the base sheet 12 is counterfolded at the front bottom fold 20 to delineate the front cover panel 24, while the front portion of the divider sheet 14 is counterfolded at the front bottom fold 38 to form the front divider panel 62. Similarly, the rear portion of the base sheet 12 is counterfolded at the rear bottom fold 22 to delineate the back cover panel 26. The area of the base sheet 12 lying between the front and rear bottom folds 20 and 22 thereof forms the narrow spine panel 23.

Likewise, the rear portion of the divider sheet 14 is counterfolded at the rear bottom fold 40 to delineate the rear divider panel 64. The area of the divider sheet 14 lying between the front and rear bottom folds 38 and 40 thereof forms the narrow binder panel 47. The binder panel 47 is collapsible. It has a front collapsible section 49 formed between the divider center fold 36 and the divider front bottom fold 38, and a rear collapsible section 51 formed between the divider center fold 36 and the divider rear bottom fold 40.

As illustrated in FIG. 3, the bottom portions of both the folded base sheet 12 and the divider sheet 14 that form the spine panel 23 and the binder panel 47 assume a "W-shaped" configuration. The spine panel 23 and the binder panel 47 respectively fold in half at the center folds 18 and 36. The spine panel 23 and the binder panel 47 thereby are collapsible so as to vary the angles formed at the center folds 18 and 36. As illustrated in FIG. 3, the front line of attachment 46 resides between the center folds 18,36 and the front folds 20,38. The rear line of attachment 48 resides between the center folds 18,36 and the rear folds 22,40.

The side panels 28 and 30 are folded toward each other to span the distance of separation between the front panel 24 and the rear panel 26 of the base sheet 12. After the base sheet 12 and divider sheet 14 have been folded along the rear bottom folds 22 and 40, the side panels 28 and 30 are folded inwardly toward each other. That is, in the embodiment of FIGS. 1–3 the side panels 28 and 30 are folded in a longitudinal direction inwardly and forwardly along side edge folds 32 toward the front panel 24 when the structure is in an upright condition, as illustrated in FIG. 1. The longitudinal, side edge folds 32 delineate the rear panel 26 from the side panels 28 and 30.

Once the side panels 28 and 30 are folded inwardly, the bottom attachment tongues 50 and 52 are folded upwardly along transverse fold lines 71 so as to clear the spine panel 23 and binder panel 47, whereupon they reside atop the binder panel 47. The bottom attachment tongues 50 and 52 are then heat sealed at points of attachment to the upper surface of the binder panel 47 of the divider sheet 14 in between the transverse bottom fold lines 38 and 40 thereof. The bottom attachment tongues 50 and 52 are secured to both the spine panel 23 and binder panel 47 by spot welds on both sides of the central folds 18,36. The bottom attachment tongues 50 and 52 are directed toward each other and are sealed to the upper surface of the divider sheet 14 between the front fold 38 and the rear fold 40 therein. The base sheet 12 and divider sheet 14 are then folded upwardly along the front bottom folds 20,38 to bring the front panel 24 up into generally parallel disposition relative to the rear panel 26, as illustrated in FIG. 3.

After the side panels 28 and 30 are folded at the side edge folds 32 from the rear panel 26 toward the front panel 24, and after the fastening tongues have been secured to the binder panel 47, the side panels 28 and 30 are also doubled back upon themselves to form bifurcating folds 34. The distal portions of the side panels 28 and 30 beyond the bifurcating folds 34 are then folded again longitudinally at 35 to delineate the fastening tabs 37. The fastening tabs 37 of the side panels 28 and 30 are folded over across the front panel 24 at fold lines 35 as illustrated in FIG. 1.

After the longitudinal, bifurcating folds 34 have been formed in the side panels 28 and 30 and the distal ends of the side flaps 28 and 30 have been folded at 35, the distal edge extremities of side flaps 28 and 30 forming the fastening tabs 37 are heat sealed to the outer surface of the front panel 24 by the lines of heat sealing 82 and 84, visible in FIG. 1. The fastening tabs 37 of the side panels 28 and 30 are heat sealed by the lines of heat sealing 82 and 84 from the bottom edge of the front panel 24 to the top edge thereof in continuous lines of sealing. The fastening tabs 37 are configured to extend from the bottom to the top of the front panel 24.

As is evident from FIG. 3, three pockets are formed within the collapsible envelope 10. Specifically, a front pocket 39 is formed between the front cover panel 24 and the front divider panel 62. An intermediate pocket 41 is formed between the front divider panel 62 and the rear panel divider 64. A rear pocket 43 is formed between the rear divider panel 24 and the rear cover panel 26.

As is evident from FIG. 3, papers cannot slide down underneath either of the divider panels 62 or 64. This is impossible, since the transverse linear lines of sealing 46 and 48 provide a closure across the entire width of the expanding envelope 10 between all of the pockets 39, 41, and 43.

The method of expanding envelope fabrication, and the structure produced by this method provide a simple, but very effective expanding envelope 10 that includes built-in divider panels 62 and 64. The simplicity of construction, coupled with the secure connections provided by the lines of heat sealing 46,48 and 82,84 provide a most effective and economical collapsible expanding envelope 10. Furthermore, by providing the device with the fastening tongues 50 and 52 which are securely joined to the narrow binder panel 47 and the narrow spine panel 23, the expandable envelope 10 is provided with lower corners that are not only closed, but reinforced as well. As a consequence, small, sharp objects, such as pens and pencils, even if dropped to the bottom of the expanding envelope 10, cannot be forced transversely out of the expanding envelope 10 through interstitial gaps between the various folded layers of the base sheet 12 and divider sheet 14.

Figure 4:
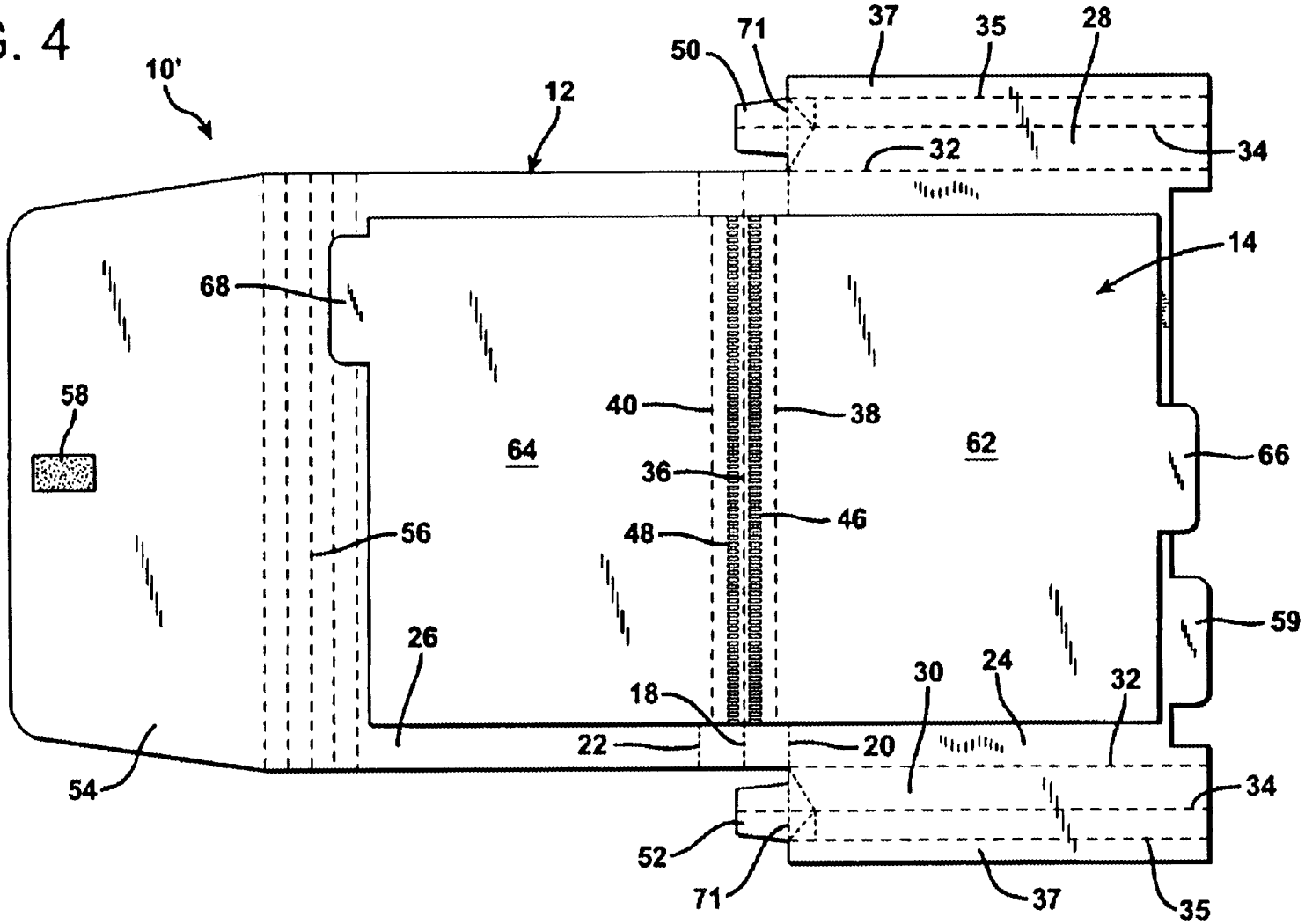
FIG. 4 is a top plan view illustrating an alternative embodiment of the invention to that shown in FIG. 2.

It can be seen that in the embodiment of FIGS. 1–3, the side panels 28 and 30 are formed as lateral extensions from the rear cover panel 26 and are secured to the front cover panel 24 by longitudinal lines of sealing 82 and 84 from the tops to the bottoms of the side panels 28 and 30. However, the side panels 28 and 30 can project laterally outwardly from either the front panel 24 or the rear panel 26, as in the expanding envelope 10' shown in FIG. 4. As shown in the embodiment of the invention illustrated in FIG. 4, the side panels 28 and 30 can project laterally outwardly from the front panel 24. Their distal extremities are then secured to the rear panel 26 from the top to bottom by lines of heat sealing 82, 84, in the manner previously described.

Undoubtedly, numerous other variations and modifications of the invention will become readily apparent to those familiar with expandable file folders. For example, the bottom attachment flaps 50 and 52 could be inserted in between the spine panel 23 and the binding panel 47. Also, while heat sealing is the preferred manner of attachment of the plastic base sheet 12 and divider sheet 14 in the embodiment illustrated, other conventional means of attachment could be employed. For example the base sheet 12 and divider sheet 14 could be secured to each other by adhesive or sonic welding. Also, the base sheet 12 and divider sheet 14 are not necessarily formed of plastic, but can be formed of card stock, fabric, or various other materials. Also, the divider sheet 14 can have a color different from that of the base sheet 12 so as to provide a color coding of some of the pockets therebetween. Accordingly, the scope of the invention should not be construed as limited to the specific embodiments illustrated or the implementation of the method described, but rather is defined in the claims appended hereto.

I claim:

1. An expanding envelope with built-in dividers comprising:

an expansive base sheet formed of a resilient stiff material delineated into a front cover panel, a rear cover panel, collapsible side panels on opposite sides of said front and rear cover panels, and a narrow spine panel located between said front and rear cover panels and delineated therefrom by a pair of base sheet bottom folds, and said spine panel is divided transversely by a center fold into front and rear collapsible sections, and an expansive divider sheet formed of a resilient, stiff material delineated into front and rear divider panels and a binder panel located between said front and rear divider panels and said binder panel is divided transversely by a center fold into front and rear collapsible sections, and wherein said front and rear collapsible sections of said binder panel are respectively secured to said front and rear collapsible sections of said spine panel, and said collapsible side panels are both divided by center folds at which they are collapsible, and said side panels secure said front and rear cover panels to each other with said front and rear divider panels located therebetween and with said center folds of said side panels extending substantially parallel to said front and rear cover panels.

2. An expanding envelope according to claim 1 wherein said base sheet further defines a top closure flap projecting upwardly from said rear cover panel and said base sheet is folded transversely between said top closure flap and said rear cover panel so that said top closure flap encloses at least a portion of said front cover panel therewithin.

3. An expanding envelope according to claim 2 further comprising releaseable closure elements on said front cover panel and said top closure flap to releaseably hold said top closure flap against said front cover panel.

4. An expanding envelope according to claim 1 wherein said base sheet and said divider sheet are both formed of plastic and said front and rear collapsible sections of said binder panel are respectively secured to said front and rear collapsible sections of said spine panel by heat sealing.

5. An expanding envelope according to claim 4 wherein said front and rear collapsible sections of said binder panel and said front and rear collapsible sections of said spine panel are heat sealed together along continuous lines of sealing that are parallel to and spaced from said center folds formed in said binder and spine panels.

6. An expanding envelope according to claim 5 wherein said collapsible side panels are formed as lateral extensions from one of said front and rear cover panels and are heat sealed to the other of said front and rear cover panels.

7. An expanding envelope according to claim 6 wherein the other of said front and rear cover panels has a lower edge bounded by one of said base sheet bottom folds and an opposite upper edge, and said collapsible side panels are heat sealed to said other of said front and rear panels by continuous, linear lines of heat sealing that extend between said upper and lower edges of said other of said front and rear cover panels.

8. An expanding envelope according to claim 7 wherein said collapsible side panels have bottom fastening tongues that project beyond said one of said front and rear cover panels, and said bottom fastening tongues are folded inwardly toward each other and are sealed to both said spine panel and said binder panel.

9. An expanding envelope with built-in dividers comprising an expansive base sheet and an expansive divider sheet, both formed of a resilient, stiff material, characterized in that said base sheet is folded transversely to form a base sheet center fold and counter folded transversely on both sides of said base sheet center fold to form a pair of base sheet bottom folds parallel to and spaced from said base sheet center fold so that said base sheet is collapsible at said base sheet center fold and thereby also delineating front and rear envelope panels from said base sheet that project upwardly from said bottom folds, and said base sheet further defines laterally projecting side panels that extend between and permanently secure said front and rear envelope panels together in mutually facing relationship, and said side panels are folded inwardly toward each other and are doubled back to delineate bifurcating side panel folds perpendicular to said base sheet center fold, whereby said side panels are collapsible at said bifurcating side panel folds, and further characterized in that said divider sheet is folded transversely to form a divider sheet center fold parallel to and in registration with said base sheet center fold and said divider sheet is counterfolded to form divider sheet bottom folds parallel to and spaced from said divider sheet center fold, thereby delineating front and rear divider panels located between and respectively facing said front and rear envelope panels and said divider sheet center fold lies adjacent and parallel to said base sheet center fold, and said base sheet and said divider sheet are permanently secured together between said center folds and said bottom folds.

10. An expanding envelope according to claim 9 wherein said base sheet and said divider sheet are permanently secured together between said center folds and said bottom folds by continuous lines of sealing located parallel to said bottom folds.

11. An expanding envelope according to claim 10 wherein said base sheet and said divider sheet are permanently secured together by heat sealing.

12. An expanding envelope according to claim 9 wherein said side panels are formed as lateral extensions from one of said front and rear envelope panels and are permanently secured to said other of said front and rear envelope panels by continuous lines of sealing.

13. An expanding envelope according to claim 12 further comprising fastening tongue extensions on said base sheet projecting from said side panels proximate one of said base sheet bottom folds, and said fastening tongue extensions project toward each other and are secured to said divider sheet between said divider sheet bottom folds.

14. An expanding envelope according to claim 9 wherein said base sheet and said divider sheet are formed of plastic and are permanently secured together by lines of heat sealing.

15. A method of fabricating an expandable envelope with built-in dividers utilizing an expansive base sheet having opposing side panels and an expansive divider sheet, both formed of a resilient, stiff material comprising:

positioning said divider sheet atop said base sheet in contact therewith, permanently securing said divider sheet and said base sheet together along a pair of mutually parallel, transverse front and rear lines of attachment folding said base sheet and said divider sheet upwardly together parallel to and between said transverse lines of attachment to create transverse, collapsible center folds therein, counterfolding said base sheet and said divider sheet together in both front and rear mutually parallel transverse bottom folds so that said front line of attachment resides between said center folds and said front bottom folds and so that said rear line of attachment resides between said center folds and said rear bottom folds, thereby creating from said base sheet front and rear cover panels, each having a top and a bottom, and thereby also creating from said divider sheet a pair of divider panels between said front and rear cover panels, and whereby said side panels project outwardly from a first one of said front and rear cover panels, folding both of said side panels of said base sheet toward each other to span the distance of separation between said front and rear cover panels, folding each of said side panels longitudinally back upon itself so as to form a longitudinal, center fold in each of said side panels, and permanently securing said side panels to a second one of said front and rear cover panels longitudinally from said top to said bottom thereof.

16. A method according to claim 15 wherein said base sheet and said divider sheet are both formed of plastic and said divider sheet and said base sheet are permanently secured together by heat sealing.

17. A method according to claim 15 wherein said base sheet includes bottom attachment tongues projecting from said side panels and said bottom attachment tongues are directed toward each other and further comprising sealing said bottom attachment tongues to said divider sheet between said front and rear bottom folds therein.

* * * * *